US008387905B2

(12) United States Patent
Solomon et al.

(10) Patent No.: US 8,387,905 B2
(45) Date of Patent: Mar. 5, 2013

(54) MODULAR SHELL FOR CRUSHER DEVICE

(75) Inventors: Mark Solomon, Orefield, PA (US); Chris Littleford, Scotrun, PA (US); Harold B. Loyer, Tuscon, AZ (US)

(73) Assignee: FLSmidth A/S (DK)

( * ) Notice: Subject to any disclaimer, the term of this patent is extended or adjusted under 35 U.S.C. 154(b) by 245 days.

(21) Appl. No.: 12/907,269

(22) Filed: Oct. 19, 2010

(65) Prior Publication Data

US 2012/0091241 A1 Apr. 19, 2012

(51) Int. Cl.
*B02C 2/00* (2006.01)

(52) U.S. Cl. ..... 241/207

(58) Field of Classification Search ..... 241/207–219, 241/285.1

See application file for complete search history.

(56) References Cited

U.S. PATENT DOCUMENTS

| | | | | |
|---|---|---|---|---|
| 2,155,393 | A | 4/1930 | Battey | |
| 2,860,837 | A | 8/1953 | Werner | |
| 3,150,839 | A | 9/1964 | Motz | |
| 3,151,816 | A | 10/1964 | Hanse et al. | |
| 3,302,896 | A * | 2/1967 | Balmer et al. | 241/285.1 |
| 3,467,322 | A | 9/1969 | Levishko et al. | |
| 3,774,857 | A | 11/1973 | Decker et al. | |
| 3,774,858 | A | 11/1973 | Archer et al. | |
| 3,843,068 | A | 10/1974 | Allen et al. | |
| 3,966,130 | A | 6/1976 | Doty | |
| 4,168,036 | A | 9/1979 | Werginz | |
| 4,478,373 | A * | 10/1984 | Gieschen | 241/208 |
| 4,679,741 | A | 7/1987 | Hansen | |
| 4,756,484 | A | 7/1988 | Bechler et al. | |
| 5,019,196 | A | 5/1991 | McKibben et al. | |
| 5,738,288 | A | 4/1998 | Karra | |
| 6,000,648 | A | 12/1999 | Ambrose | |
| 6,213,418 | B1 * | 4/2001 | Gabriel et al. | 241/207 |
| 7,152,822 | B2 | 12/2006 | Evertsson | |
| 2009/0289135 | A1 | 11/2009 | Solomon et al. | |
| 2011/0192927 | A1 | 8/2011 | Biggin et al. | |

OTHER PUBLICATIONS

International Search Report and Written Opinion dated Feb. 21, 2012, 8 pages.

* cited by examiner

*Primary Examiner* — Faye Francis
(74) *Attorney, Agent, or Firm* — Daniel DeJoseph; Aaron M. Pile; Jeffrey A. Sharp

(57) ABSTRACT

A modular bottom shell of a multi-shell crusher device, the shell includes a central hub having a centered cylindrical support hole and at least two support arms extending orthogonally from the centered cylindrical support hole, each support arm having an end plate, and wherein at least one of the two support arms has an orthogonal bore therein which extends from within the centered cylindrical support hole to an outer portion of the support arm; and at least two outer shell sections having an annular inner surface, and wherein each of the outer shell sections has an upper surface and a lower surface, the upper and lower surfaces extending from one end of the outer shell section to the other end of the outer shell, and a first vertical end plate on one end of the outer shell section and a second vertical end plate on the other end of the outer shell section, and wherein each vertical end plate has at least one bore therein, which has a corresponding bore within one of the end plates of the support arm.

17 Claims, 5 Drawing Sheets

MODULAR SHELL FOR CRUSHER DEVICE

FIELD OF INVENTION

The present invention relates to crushing devices and, more particularly, to a modular bottom shell for gyratory crushers and/or cone crushers.

BACKGROUND OF THE INVENTION

Crushing devices, such as cone crushers and gyratory crushers, are typically used to crush rock, ore or minerals. Crushers may form a circuit of a process configured to crush material from a first size to a smaller size. After the material is crushed, the material may be moved to a grinding circuit for grinding the material to an even smaller size.

One type of crushing device that is commonly used is a cone crusher, which typically breaks rock by squeezing the rock between an eccentrically gyrating spindle and an enclosing concave hopper. As rock enters the top of the cone crusher, it becomes wedged and squeezed between the mantle and the bowl liner or concave. Large pieces of ore or rock are broken and then fall to a lower position (because they are now smaller) where they are broken again. This process continues until the pieces are small enough to fall through a narrow opening at the bottom of the crusher. The crusher head of cone crushers is typically guided by an eccentric assembly to actuate movement of the head for crushing material. It can be appreciated that there are generally two types of cone crusher designs. One in which the concave hopper can be adjusted in position relative to the gyrating spindle to adjust for wear and change product size. The other type is designed such that the gyrating spindle can be raised and lowered.

Gyratory crushers are also well established machines that are used for crushing rocks, ore, and other materials. A gyratory crusher is a cone crusher designed for very large feed. The gyratory crusher is usually the first stage of size reduction equipment in a mining operation. They are very large and their basic structure comprises a bowl shaped as a cone with the wider end of the cone near the top of the crusher. A conical head assembly is located on the axis of the bowl, and the head assembly is oriented so that its smaller dimension is at the top of the crusher. To perform the crushing action gyratory motions are applied to the conical head assembly.

In the typical gyratory crusher, large material is fed into the top of the crusher between the large opening of the bowl and the small end of the head assembly where the volume is largest. The gyration of the head assembly is furnished by an eccentric assembly, the rotation of which is driven by a gear. Vertical support and minor vertical adjustment of the head assembly is furnished by a hydraulic support assembly. These parts are typically located at the bottom of the crusher, and more specifically they are located at the bottom of the conical head assembly. The gyration applies forces that crush the pieces of material, and they fall lower into the reduced space within the bowl as they are reduced in size. Ultimately, the material leaves the crusher through openings at the bottom of the crusher.

Gyratory and cone crushers typically are constructed from large steel castings. However, suppliers for such castings are limited, which can result in long lead times and potentially lost orders. In addition, large steel castings are expensive and can be difficult to transport to job sites.

Accordingly, it can be would be desirable to replace the traditional large steel casting with a modular casting, which includes a central hub and a plurality of modular shells having a vertical split therein and upon assembly thereof form a modular bottom shell or mainframe for use with gyratory and/or cone crushers.

SUMMARY OF THE INVENTION

In accordance with an exemplary embodiment, a modular bottom shell of a multi-shell crusher device, the shell comprises a central hub having a centered cylindrical support hole and at least two support arms extending orthogonally from the centered cylindrical support hole, each support arm having an end plate, and wherein at least one of the two support arms has an orthogonal bore therein which extends from within the centered cylindrical support hole to an outer portion of the support arm; and at least two outer shell sections having an annular inner surface, and wherein each of the outer shell sections has an upper surface and a lower surface, the upper and lower surfaces extending from one end of the outer shell section to the other end of the outer shell, and a first vertical end plate on one end of the outer shell section and a second vertical end plate on the other end of the outer shell section, and wherein each vertical end plate has at least one bore therein, which has a corresponding bore within one of the end plates of the support arm.

In accordance with another exemplary embodiment, a modular bottom shell of a multi-shell crusher device, the shell comprises: a central hub having at least two support arms extending orthogonally from the centered cylindrical support hole, and wherein each support arm has an end plate; and a plurality of outer shell sections having an annular inner surface, and wherein each of the outer shell sections has an upper surface and a lower surface, the upper and lower surfaces extending from one end of the outer shell section to the other end of the outer shell, and a first vertical end plate on one end of the outer shell section and a second vertical end plate on the other end of the outer shell section, and wherein each vertical end plate has at least one bore therein, which has a corresponding bore within one of the end plates of the support arm.

In accordance with a further exemplary embodiment, a method of assembling a modular bottom shell for a multi-shell crusher device comprises the steps of providing a central hub having at least two support arms extending orthogonally from the centered cylindrical support hole, and wherein each support arm has an end plate; and securing a plurality of outer shell sections to the end plates of the at least two support arms, wherein each of the outer shell sections has an upper surface and a lower surface, and a first vertical end plate on one end of the outer shell section and a second vertical end plate on the other end of the outer shell section, and wherein each vertical end plate has at least one bore therein, which has a corresponding bore within one of the end plates of the support arm.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of crushing devices, such as gyratory crushers, crushing circuits or cone crushers, and methods of making and/or assembly of such devices are shown in the accompanying drawings in which.

DETAILED DESCRIPTION OF PRESENT PREFERRED EMBODIMENTS

Figure 1:
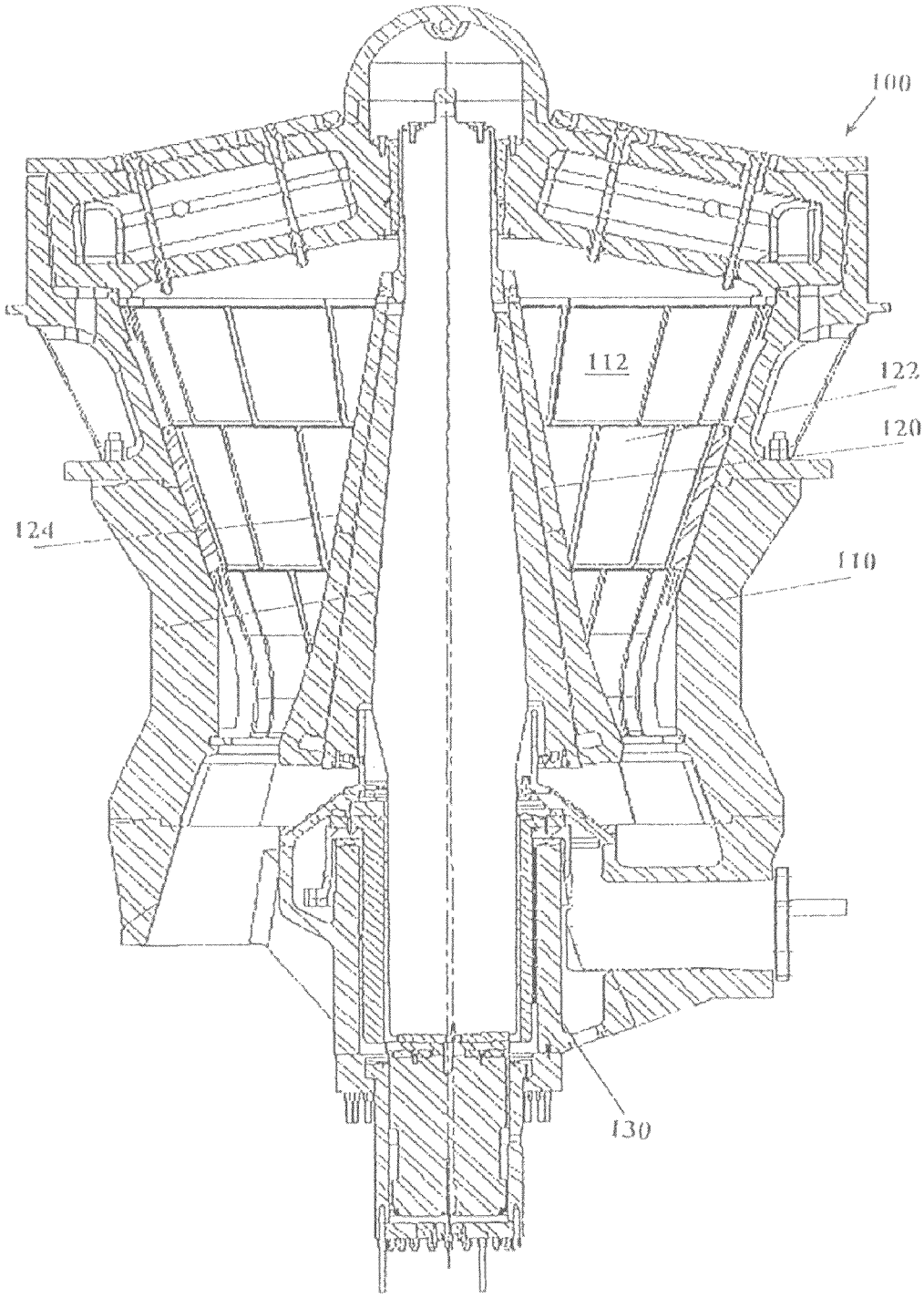
FIG. 1 is a cross sectional view of a gyratory crusher in accordance with an exemplary embodiment.

Reference will now be made in detail to the present preferred embodiments of the invention, examples of which are illustrated in the accompanying drawings. Wherever possible, the same reference numbers are used in the drawings and the description to refer to the same or like parts.

Figure 3:
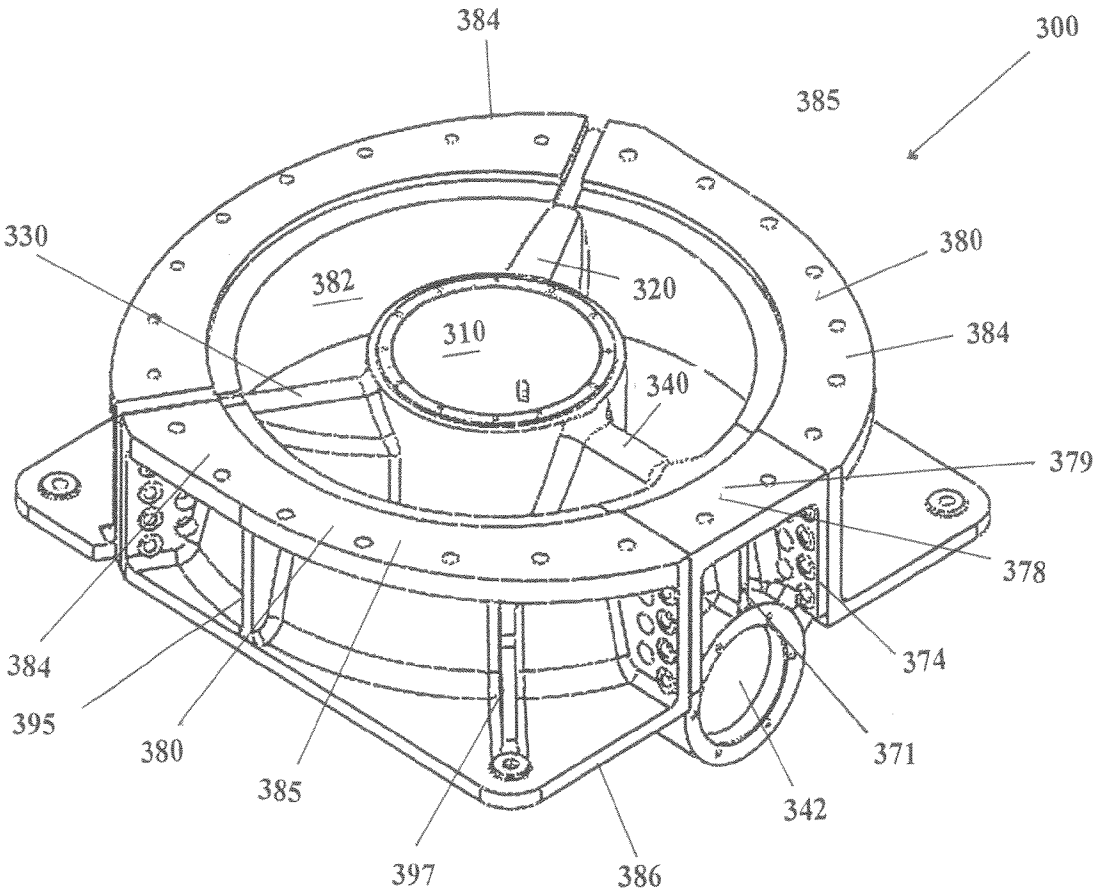
FIG. 3 is a perspective view of a modular bottom shell or mainframe for use with a crusher device in accordance with another exemplary embodiment.
Figure 4:
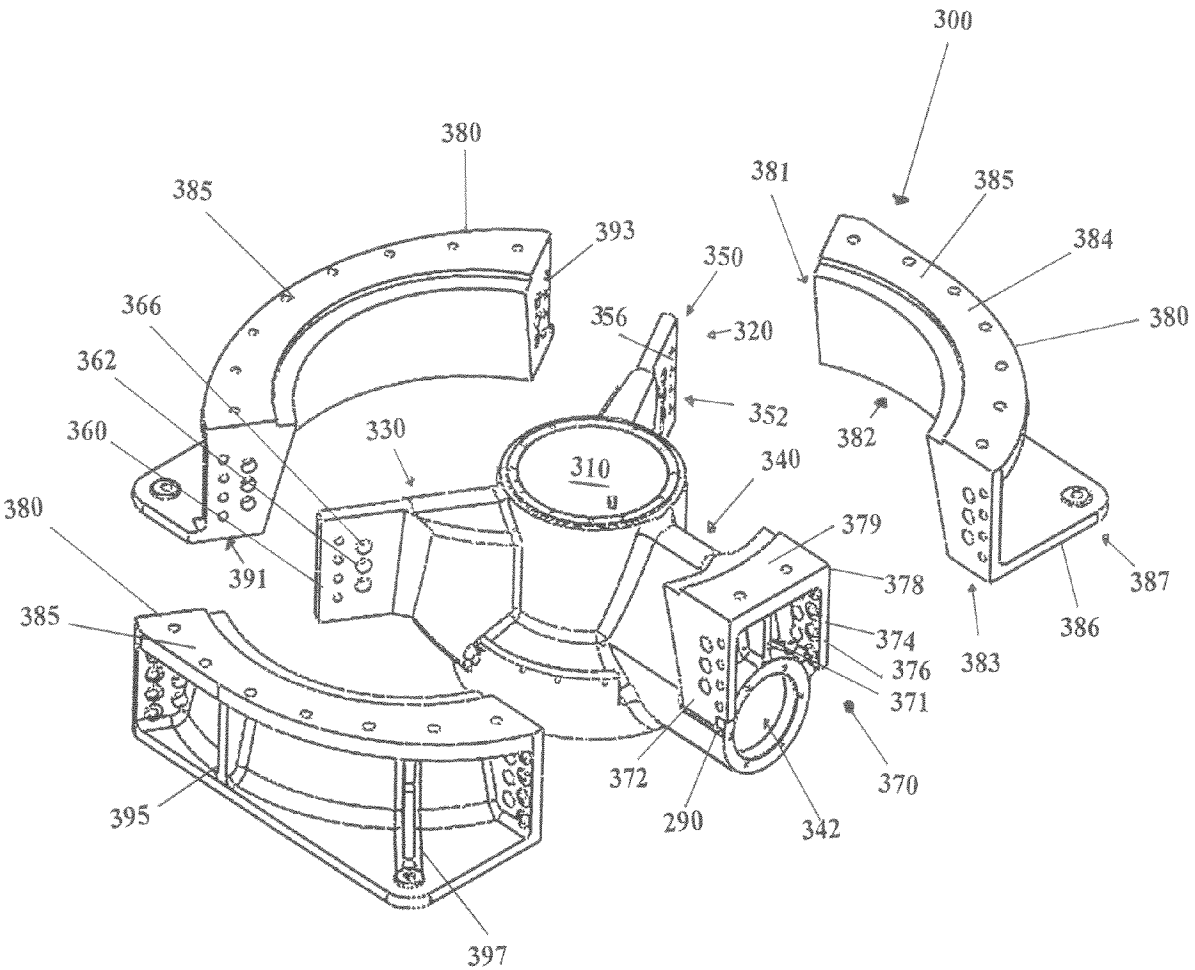
FIG. 4 is an expanded perspective view of the modular bottom shell or mainframe as shown in FIG. 3 in accordance with an exemplary embodiment.

FIG. 1 is a cross sectional view of a gyratory crusher 100 in accordance with an exemplary embodiment. As shown in FIG. 1, the gyrator crusher 100 includes a bowl or shell 110 shaped as a cone with its wider opening at the top, and head assembly 120 which is located on an axis inclined relative to the axis of bowl 110. The head assembly 120 is shaped as a cone and has its larger diameter at the lower end of bowl 110 so that together the bowl 110 and the head assembly 120 form crushing volume 122 which is larger at the top and smaller at the lower end. This configuration permits larger material to be fed into the top of crusher 100, and which falls to the bottom of bowl 110 as it is crushed into smaller pieces and exits crusher 100. Typically, both the bowl 110 and the head assembly 120 have replaceable working surfaces. The bowl 110 has a liner 112, called a "concave" in the industry, and head assembly 120 has a liner 124 referred to as a "mantle". The bowl 110 (or outer shell) preferably is an annular shell, which includes a modular bottom shell (or lower modular component) 200 (FIGS. 2-4).

The head assembly 120 is located adjacent to an eccentric assembly 130 which is rotated by a ring gear. In accordance with an exemplary embodiment, the eccentric assembly 130, within which the lower portion of a main shaft is held, imparts to the head assembly 120 an eccentric motion, essentially a gyration, for the crusher 100 to function. The motion is imparted to the head assembly 120 by the eccentric assembly 130 that has an eccentric center volume, although the eccentric assembly 130 is itself cylindrical and mounted in a centered cylindrical support hole within a center hub. The eccentric assembly 130 along with the annular shell 110 is part of the bottom support structure of crusher 100. The eccentric assembly 130 rotates about the centered cylindrical support hole and, as eccentric assembly 130 rotates, its eccentric center volume moves the bottom end of mainshaft in an eccentric path imparting the gyratory motion to head assembly 120.

Figure 2:
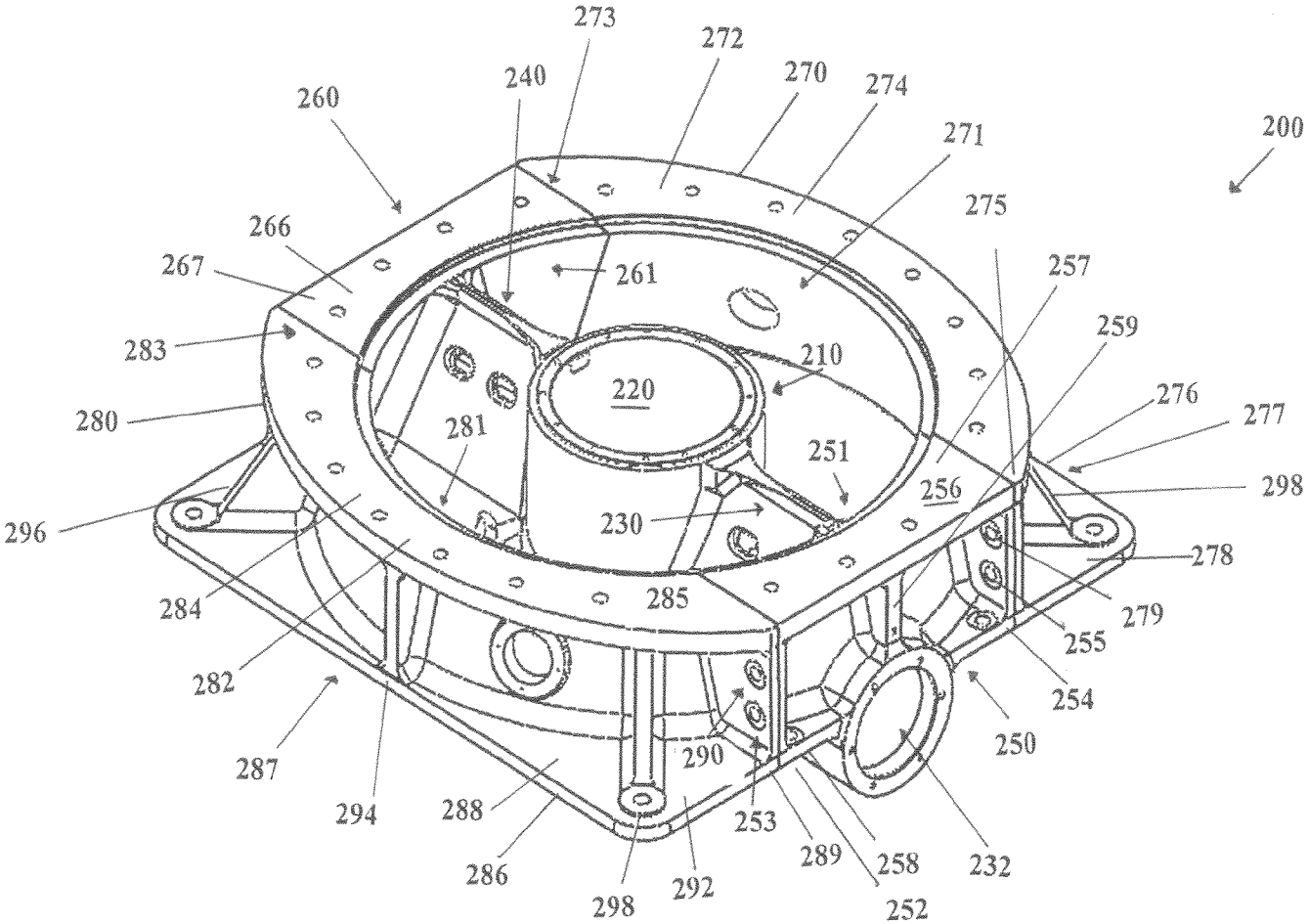
FIG. 2 is a perspective view of a modular bottom shell or mainframe for use with a crusher device in accordance with an exemplary embodiment.

FIG. 2 is a perspective view of a modular bottom shell 200 for a crusher device in accordance with an exemplary embodiment. As shown in FIG. 2, the modular bottom shell 200 includes a central hub (or central hub portion) 210 and at least two outer shell sections (or modular shells) 270, 280, having a vertical split therein, and upon assembly thereof forms a mainframe (or modular base) for a gyratory crusher or cone crusher device 100.

As shown in FIG. 2, the central hub portion 210 has a cylindrical center hole (or centered cylindrical support hole) 220, and at least two support arms 230, 240 extending orthogonally (or outward) from the center hole 220. The two support arms 230, 240 in accordance with an exemplary embodiment are approximately 180 degrees to one another. Each support arm 230, 240 also preferably has an end plate 250, 260 attached thereto. Each end plate 250, 260 preferably includes a pair of vertical plate members 252, 254, which have one or more bores (or holes) 253, 255. The one or more bores (or holes) 255 extend through each of the vertical plate members 254 and are configured to receive a fastener 290, which attaches the central hub 210 to the at least two outer shell sections 270, 280, which forms the modular bottom shell (or mainframe) 200.

As shown in FIG. 2, each of the end plates 250, 260 in accordance with a preferred embodiment, also includes an upper horizontal plate member 256, 266 preferably having a relatively flat upper surface 257, 267. The relatively flat upper surface 257, 267 has one or more bores extending therethrough and which correspond to a plurality of bores and/or holes associated with an upper annular shell. In accordance with an exemplary embodiment, each of the end plates 250, 260 can also include a lower plate member 258. It can be appreciated that in accordance with another exemplary embodiment, each of the end plates has one or more ribs or flanges 259, which provide additional support and stability to the end plates 250, 260. The upper horizontal plate member and the lower plate members 256, 258, 266 form the respective upper plate member or surface, and base member of the bottom modular base (or mainframe) 200. In accordance with an exemplary embodiment, an inner surface 251, 261 of the each of the vertical plate members 252, 262 forms a portion of an annular ring and has an conical configuration thereto. In addition, in accordance with an exemplary embodiment, the upper horizontal plate members 256, 266 are configured to accommodate one or more annular components or shells, which upon assembly thereof with the modular bottom shell 200 forms the bowl or shell 110 of the crusher device 100.

In accordance with an exemplary embodiment, at least one of the two support arms 230, 240 has an orthogonal bore 232 therein and which extends from within the central hub 210 to an outer portion of the support arm 230, 240. The at least one orthogonal bore 232 is preferably configured to house a drive shaft, which imparts to the head assembly 120 (FIG. 1) an eccentric motion, essentially a gyration, for the crusher 100 to function.

In accordance with another exemplary embodiment, each of the two support arms 230, 240 has an orthogonal bore 232 therein which extends from within the central hub 210 to an outer portion of the support arms 230, 240. As shown in FIG. 2, the at least one orthogonal bore 232 is preferably positioned on a lower portion of the corresponding support arm 230, 240.

As shown in FIG. 2, each of the outer shell sections 270, 280 includes an upper member (or upper plate) 272, 282 having a relatively flat or horizontal upper surface 274, 284, and a lower member (or lower plate) 276, 286 having relatively flat or horizontal lower surface 278, 288. The at least two outer shell sections 270, 280 have an inner surface 271, 281, which extends from the upper member 272, 282 to the lower member 276, 286, which forms a portion of an annular ring and which is conical in shape. In accordance with an exemplary embodiment, the upper member 272, 282 preferably has a generally annular shape thereto and extends from one end 273, 283 of the outer shell section 270, 280 to the other end 275, 285 of the outer shell section 270, 280. The relatively flat or horizontal upper surface 274, 284 also preferably includes a plurality of bores (or holes) extending therethrough and which correspond to a plurality of bores and/or holes associated with an upper annular shell, which when assembled forms the bowl or shell 110 of the crusher device 100. In accordance with an exemplary embodiment as shown in FIG. 2, the lower member (or plate) 276, 286 has a generally rectangular configuration on an outer surface 277, 287 thereof and a circular configuration or circumference on an inner surface 271, 281 thereof. The lower member (or plate) 276, 286 also preferably includes a plurality of bore (or holes), which assists with the securing of the modular bottom shell 200 to a platform and/or other structure (not shown).

Each of the outer shell sections (or horizontal sections) 270, 280 also preferably include a first vertical end plate 279, 289 on one end and a second vertical end plate (not shown) on the other end. Each vertical end plates has one or more bores (or holes) 253 therein, which is configured to receive a fastener 290, which extends through a corresponding bore (or hole) 255 on each of the vertical plates 252, 254 of the central hub 210 when the modular bottom shell 200 is assembled. It can be appreciated that in accordance with an exemplary embodiment, the outer lower shell sections 270, 280 are identical, such that each of the outer lower shell sections 270, 280 is interchangeable with other outer lower shell sections 270, 280.

In accordance with an exemplary embodiment, the at least two outer shell sections 270, 280 have an C-shaped cross-sectional configuration, which extends from the upper member (or upper plate) 272, 282 to the lower member (or lower plate) 276, 286. In addition, the at least two outer shell sections 270, 280 preferably include at least one support rib (or gusset plate) 292, which extends from an underside of the upper member (or upper plate) 272, 282 to an upper surface of the lower member (or lower plate) 276, 286. It can be appreciated that the at least one support rib (or gusset) can have any suitable configuration and/or shape to provide further structural support to the modular bottom shell 200. For example, in accordance with an exemplary embodiment, each of the outer shell sections 270, 280 includes a central support rib 294 and a pair of outer support ribs 296, 298, which extend from the upper member (or upper plate) 272, 282 to the lower member (or lower plate) 276, 286 and have a generally triangular profile or shape.

In accordance with an exemplary embodiment, upon assembly of the central hub 210 and the at least two outer shell sections 270, 280, the upper horizontal plate member 256, 266 of the end plate 250, 260, and the horizontal upper surfaces 274, 284 of the at least two outer shell sections 270, 280 form an annular ring having a relatively flat and/or smooth upper surface.

FIGS. 3 and 4 are perspective view of a bottom modular shell 300 for a crusher device in accordance with another exemplary embodiment. As shown in FIGS. 3 and 4, the modular bottom shell 300 includes a central hub 310 and three support arms 320, 330, 340 having a vertical split therein and extending outward therefrom, and which are 120 degrees to one another. The bottom modular shell 300 also includes a plurality of outer shell sections (or horizontal sections) 380, which upon assembly thereof forms a mainframe (or modular bottom shell) 300 for a gyratory crusher or cone crusher device.

In accordance with an exemplary embodiment, at least one of the three support arms 320, 330, 340 has a bore 342 therein which extends orthogonally (or outward) from the central hub 310 to an outer portion of the support arm 320, 330, 340, and which is configured to receive a drive shaft (not shown). Each support arm 320, 330, 340 preferably has at least one end plate 350, 360, 370 attached thereto, and preferably includes at least one vertical plate member 352, 362, 372, 374. Each of the vertical plate members 352, 362, 372, 374 preferably includes one or more bores (or holes) 356, 366, 376, which extend therethrough and are configured to receive a fastener 290.

As shown in FIGS. 3 and 4, in accordance with an exemplary embodiment, the end plate 370 positioned above the at least one of the three support arms 340 which includes a bore 342 therein, preferably includes a pair of the vertical end plates 372, 374, which are positioned on outer edge of the bore 342. The end plate 370 also includes an upper horizontal plate member 378 having a relatively flat upper surface 379. In accordance with an alternative embodiment, the end plate 370 can also include a lower plate member (not shown). It can be appreciated that in accordance with another exemplary embodiment, the end plate 370 preferably has one or more ribs or flanges 371, which provide additional support and stability to the end plate 370. It can be appreciated that the upper horizontal plate member 378 forms the upper plate member or surface of the bottom modular base (or mainframe) 300 and preferably includes one or more bores (or holes) extending therethrough and which correspond to a plurality of bores and/or holes associated with an upper annular shell member.

In accordance with an exemplary embodiment, the outer shell sections (or modular sections) 380 have an inner surface 382, which is preferably annular in shape from side to side and a conical shape from an upper edge to a lower edge. As shown in FIG. 4, each of the outer shell sections 380 includes an upper member (or upper plate) 384 having a relatively flat or horizontal upper surface 385, and a lower member (or lower plate) 386 having relatively flat or horizontal lower surface 387. The relatively flat or horizontal upper surface 384 also preferably includes a plurality of bores (or holes) extending therethrough and which correspond to a plurality of bores and/or holes associated with an upper annular shell (not shown), which when assembled forms the bowl or shell 110 of the crusher device 100. In accordance with an exemplary embodiment, the upper member 384 preferably has a generally annular shape thereto and extends from one end 381 of the outer shell section 380 to the other end 383 of the outer shell section 380.

As shown in FIGS. 3 and 4, the lower member (or plate) 386 has a generally rectangular configuration on an outer surface 387 thereof and an annular configuration or circumferential shape on the inner surface 382 thereof. The lower member (or plate) 386 also preferably includes a plurality of bore (or holes), which assists with the securing of the modular bottom shell 300 to a platform and/or other structure (not shown).

In accordance with an exemplary embodiment, each of the outer shell sections 380 have a first vertical end plate 391 on one end and a second vertical end plate 393 on the other end. Each vertical end plate 391, 393 has one or more bores (or holes) therein, which is configured to receive a fastener 290, which extends through a corresponding bore (or hole) of each of the vertical plates 352, 362, 372, 374 of the central hub 310 when the modular bottom shell 300 is assembled.

In accordance with an exemplary embodiment, the outer shell sections 380 have an C-shaped cross-sectional configuration, which extends from the upper member (or upper plate) 384 to the lower member (or lower plate) 386. In addition, the outer shell sections 380 preferably include at least one support rib (or gusset plate) 395, 397, which extends from an underside of the upper member (or upper plate) 384 to an upper surface of the lower member (or lower plate) 386. It can be appreciated that the at least one support rib (or gusset plate) can have any suitable configuration and/or shape to provide further structural support to the modular bottom shell 300.

For example, in accordance with an exemplary embodiment, each of the outer shell sections 380 includes a pair of support ribs (or gusset plates) 395, 397, which extend from the upper member (or upper plate) 384 to the lower member (or lower plate) 386 and have a generally triangular shape.

In accordance with an exemplary embodiment, upon assembly of the central hub 310 and the outer shell sections 380, the upper horizontal plate member (or portion thereof) of each of the end plate 350, 360, 370, and the outer shell sections 380 form an annular ring having a relatively flat and/or smooth upper surface.

Figure 5:
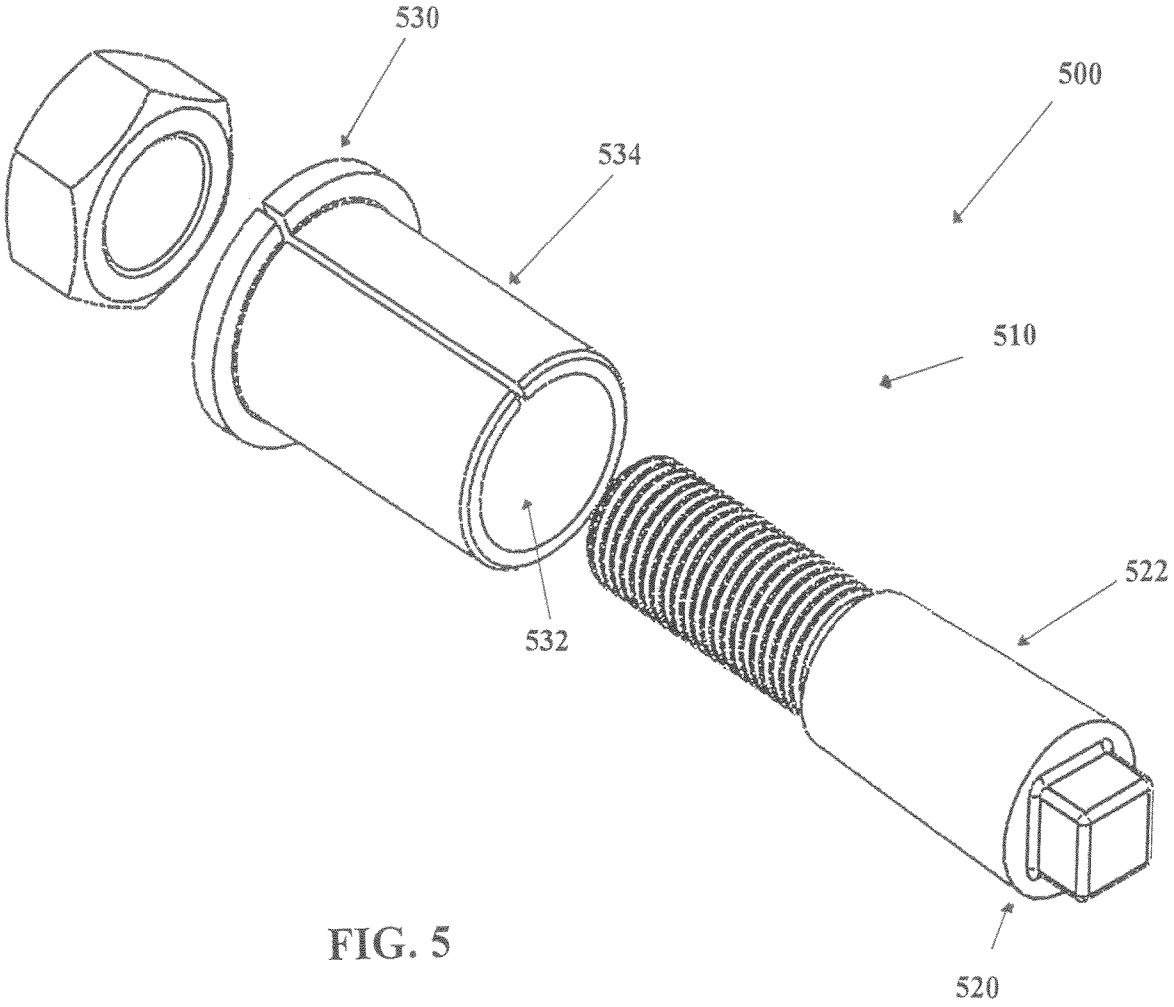
FIG. 5 is a perspective view of a bolting and shear connection type system in accordance with another exemplary embodiment.

In accordance with an exemplary embodiment, the central hub 210, 310 and the at least two outer shell sections 270, 280, 380 are secured via a bolting and shear connection type system 500 as shown in FIG. 5. In accordance with an exemplary embodiment, the bolting and shear connection type system is comprised of expanding shear pins (or plugs) 510. The expanding shear pins (or plugs) 510 preferably consist of a tapered pin 520 with a threaded end 522, a split sleeve 530 with a tapered inner diameter (ID) 532 and a cylindrical outer diameter (OD) 534, and wherein upon inserting and tightening the expanding shear pins 510, the split sleeve 530 expands filling the bore (or hole) in the two vertical plates and providing alignment and shear strength in all radial directions for the bottom modular shell 200, 300.

In accordance with another exemplary embodiment, the bottom modular shell 200, 300 is a mainframe component for a Symons style crusher that utilizes vertical splits/multi-piece lower section in addition to horizontal ring upper portion. The bottom modular shell 200, 300 is preferably attachable to one or more shells and/or structures upon assembly having a bowl shaped configuration such that upon assembly, the bottom modular shell 200, 300 is a component of a crusher device having a cone with its wider opening approaching a top of the bowl.

It should be understood that a customer may be provided with a gyratory crusher such as a cone crusher in one sale. Thereafter, a customer may be told of a method of retrofitting that cone crusher or other gyratory crusher to form a cone crusher as shown in FIGS. 1-5. The bottom modular shell may be provided by a supplier or may be purchased from the vendor that previously sold the customer the gyratory crusher. It is contemplated that the vendor or the customer may perform the retrofitting.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed is:

1. A modular bottom shell of a multi-shell crusher device, the shell comprising:

a central hub having a centered cylindrical support hole and at least two support arms extending orthogonally from the centered cylindrical support hole, each support arm having an end plate, and wherein at least one of the two support arms has an orthogonal bore therein which extends from within the centered cylindrical support hole to an outer portion of the support arm; and at least two outer shell sections having an annular inner surface, and wherein each of the outer shell sections has an upper surface and a lower surface, the upper and lower surfaces extending from one end of the outer shell section to the other end of the outer shell, and a first vertical end plate on one end of the outer shell section and a second vertical end plate on the other end of the outer shell section, and wherein each vertical end plate has at least one bore therein, which has a corresponding bore within one of the end plates of the support arm.

2. The shell of claim 1, wherein the end plate associated with the at least one of the two support arms having an orthogonal bore therein further includes a pair of vertical end plates, which are each positioned on an outer edge of the bore, and includes an upper horizontal plate member extending between the pair of vertical end plates.

3. The shell of claim 1, wherein the at least two support arms comprise two support arms each having a bore therein which extends from the centered cylindrical support hole to the outer portion of the support arm.

4. The shell of claim 3, wherein the two support arms are 180 degrees to one another.

5. The shell of claim 1, wherein the bore within the at least one of the two support arms is configured to receive a drive shaft.

6. The shell of claim 1, wherein the at least two support arms comprise three support arms, which are 120 degrees to one another.

7. The shell of claim 1, wherein the central hub and the at least two outer shell sections are secured to one another via a bolting and shear connection system.

8. The shell of claim 7, wherein the bolting and shear connection system is comprised of expanding shear pins.

9. The shell of claim 8, wherein the expanding shear pins consist of a tapered pin with a threaded end, a split sleeve with a tapered inner diameter and a cylindrical outer diameter, and wherein upon inserting and tightening the expanding shear pins, the split sleeve expands filling the bore in the end plate of the support arm and the vertical end plates of the outer shell sections.

10. The shell of claim 1, wherein the outer shell sections are interchangeable.

11. The shell of claim 1, wherein the modular bottom shell is a mainframe component for a Symons style crusher having a plurality of horizontal annular sections, which form a bowl of the crusher.

12. The shell of claim 1, wherein upon assembly of the central hub and the at least two outer shell sections, the end plates of the central hub and the at least two outer shell sections form an annular ring having a relatively flat upper surface.

13. A modular bottom shell of a multi-shell crusher device, the shell comprising:

a central hub having a centered cylindrical support hole and at least two support arms extending orthogonally from the centered cylindrical support hole, and wherein each support arm has an end plate; and a plurality of outer shell sections having an annular inner surface, and wherein each of the outer shell sections has an upper surface and a lower surface, the upper and lower surfaces extending from one end of the outer shell section to the other end of the outer shell, and a first vertical end plate on one end of the outer shell section and a second vertical end plate on the other end of the outer shell section, and wherein each vertical end plate has at least one bore therein, which has a corresponding bore within one of the end plates of the support arm.

14. The shell of claim 13, wherein the central hub further includes at least one bore extending outward from the support hole, a pair of vertical end plates which are each positioned on an outer edge of the bore, and an upper horizontal plate member extending between the pair of vertical end plates.

15. The shell of claim 13, wherein the central hub and the plurality of outer shell sections are secured via a bolting and shear connection system.

16. The shell of claim 15, wherein the bolting and shear connection system is comprised of expanding shear pins, which consist of a tapered pine with a threaded end, a split sleeve with a tapered inner diameter and a cylindrical outer diameter, and wherein upon inserting and tightening the expanding shear pins, the split sleeve expands filling the bore in the two components and providing alignment and shear strength in all radial directions.

17. The shell of claim 13, wherein the outer shell sections are interchangeable.

* * * * *